US005927083A

United States Patent [19]

Guo et al.

[11] Patent Number: 5,927,083

[45] Date of Patent: Jul. 27, 1999

[54] COMPRESSOR CYCLE DEPENDENT DEFROST CONTROL

[75] Inventors: Zhichao Guo, Fayetteville; Robert P. Dolan, Syracuse, both of N.Y.

[73] Assignee: Carrier Corporation, Syracuse, N.Y.

[21] Appl. No.: 09/036,970

[22] Filed: Mar. 9, 1998

[51] Int. Cl.[6] ..... F25D 21/00

[52] U.S. Cl. ..... 62/80; 62/155; 62/156; 62/234

[58] Field of Search ..... 62/234, 151, 152, 62/155, 156–158, 154, 80

[56] References Cited

U.S. PATENT DOCUMENTS

| | | | |
|---|---|---|---|
| 2,970,454 | 2/1961 | Everard et al. | 62/154 |
| 4,169,358 | 10/1979 | Hansen et al. | 62/154 |
| 4,417,452 | 11/1983 | Ruminsky et al. | 62/156 X |
| 4,433,555 | 2/1984 | Thorsen | 62/156 X |
| 4,510,765 | 4/1985 | Rossi | 62/154 |
| 4,882,908 | 11/1989 | White | 62/155 |
| 5,493,867 | 2/1996 | Szynal et al. | 62/155 X |
| 5,533,350 | 7/1996 | Gromala et al. | 62/155 |
| 5,533,360 | 7/1996 | Szynal et al. | 62/155 X |
| 5,564,286 | 10/1996 | Suse | 62/155 X |

*Primary Examiner*—Henry Bennett
*Assistant Examiner*—Susanne C. Tinker

[57] ABSTRACT

A defrost control for a heat exchange system initiates a defrost of the evaporator coil when a predetermined count of compressor cycles occurs and other sensed conditions indicate that defrost should be initiated. The sensed conditions include a sensed temperature of a condenser coil in the heat exchange system having dropped below a threshold temperature computed as a function of the number of compressor cycles that have occurred since the last defrost of the evaporator coil.

18 Claims, 8 Drawing Sheets

COMPRESSOR CYCLE DEPENDENT DEFROST CONTROL

BACKGROUND OF THE INVENTION

This invention relates generally to apparatus and method for defrosting the evaporator coil of a heat exchange system and, more particularly, to assuring that a defrost action of this coil is timely initiated by the heat exchange system.

The defrosting of the evaporator coil in a heat exchange system will quite often depend on the status of one or more compressors in the heat exchange system. In this regard, defrosting of this coil will usually not take place unless at least one compressor in the system has been on for a minimum period of time. This minimum period of compressor on time assures that the compressor or compressors of the heat exchange system will not be unnecessarily loaded with a defrost when these compressors have only been on for a relatively short period of time. Such a limitation on initiating defrost may however allow for a build up of frost on the evaporator coil during each relatively short period of on time under certain circumstances. In this regard, each time the compressor is turned on, the outdoor coil will possibly collect some condensation, depending on the outdoor weather conditions. If the compressor then turns off shortly after this condensation forms, it will cause some frost to build up. If the unit continues to keep doing this, each short on and off cycle of the compressor will add a little more frost until a point is reached where the frost build up becomes significant.

SUMMARY OF THE INVENTION

It is an object of the invention to timely initiate a defrost action in a heat exchange system even if certain minimum compressor operating times normally required for initiating defrost are not necessarily met.

The above and other objects of the invention are achieved by providing a heat exchange system with a defrost control that automatically tracks the number of times that the one or more compressors within the system are on for relatively short periods of time. In the event that the count of such times reaches a predetermined number, then the defrost control proceeds to examine the temperature of the evaporator coil associated with the heat exchanger. If the temperature of the evaporator coil is less than a predetermined temperature, then the defrost control will not permit the compressor to be automatically turned off even if other noted conditions for turning the compressor off are met.

The defrost control will instead proceed to implement a defrost if the same is called for after further analysis of the system. In accordance with the invention, the analysis includes computing an amount of temperature drop by which the temperature of a condenser coil in the heat exchange system may drop below a previously noted temperature for this condenser coil. The previously noted temperature is preferably the maximum noted temperature of the condenser coil to have occurred since a previous defrost or since the system was first switched on. The amount of temperature drop is preferably computed as a function of this maximum noted temperature. This computed value is preferably further adjusted by the number of cycles of the one or more compressors being switched on and then off since the last defrost action. The adjustment lessens the computed value as the number of compressor cycles since the last defrost increases. A defrost of the evaporator coil is preferably initiated if the current condenser coil temperature is below the noted maximum condenser coil temperature by the adjusted amount.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENT

Figure 1:
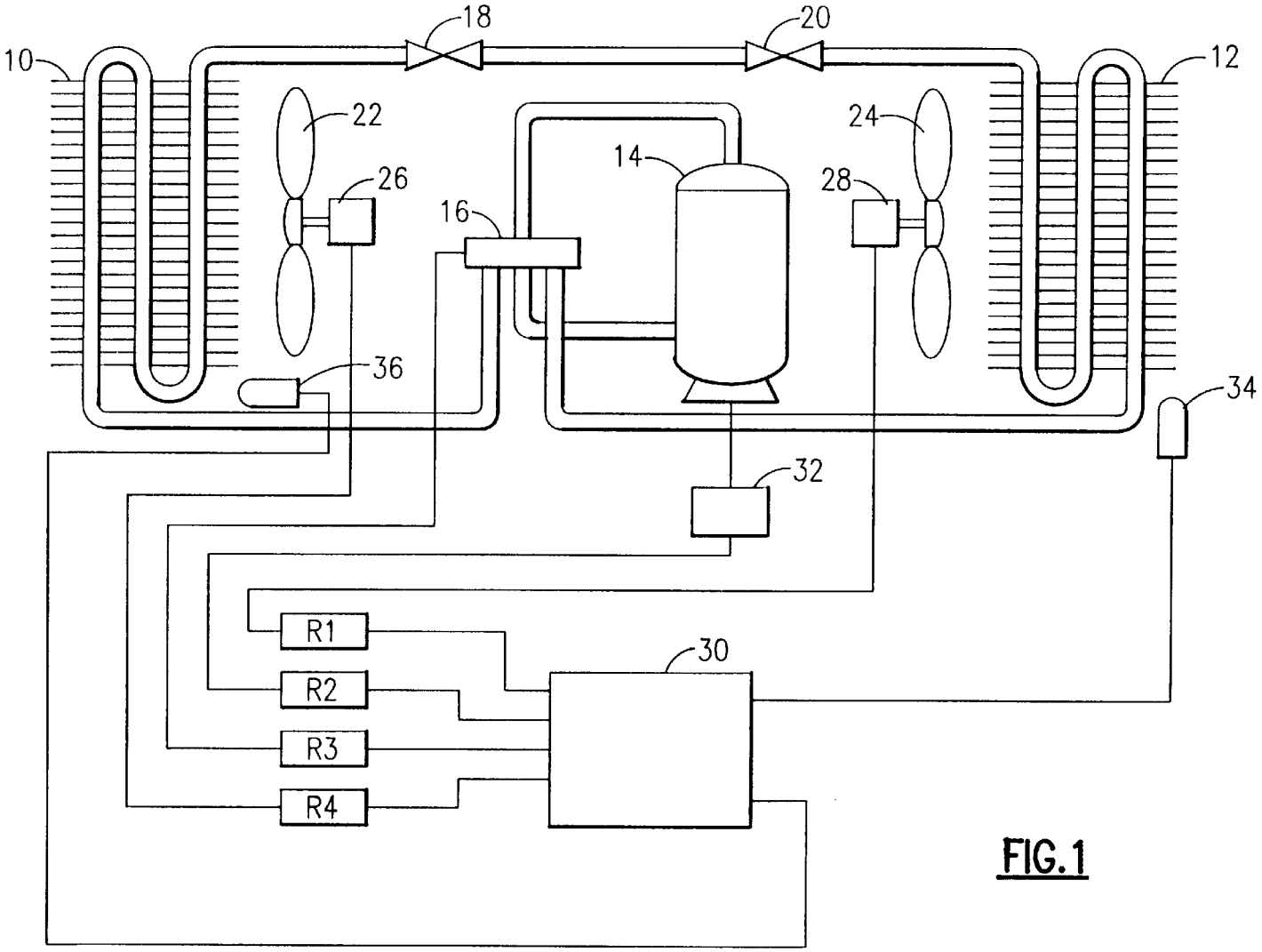
FIG. 1 is a schematic illustration of a heat pump system including a programmed computer control.

Referring to FIG. 1, a heat pump system is seen to include an indoor condenser coil 10 and an outdoor evaporator coil 12 with a compressor 14 and a reversing valve 16 located therebetween. Also located between the indoor and outdoor coils are a pair of bi-flow expansion valves 18 and 20, which allow refrigerant to flow in either direction as a result of the setting of the reversing valve 16. It is to be appreciated that all of the aforementioned components operate in a rather conventional manner so as to allow the heat pump system to provide heating to the indoor space while operating in a heating mode.

Indoor fan 22 provides a flow of air over the indoor coil 10 whereas an outdoor fan 24 provides a flow of air over the outdoor coil 12. The indoor fan 22 is driven by a fan motor 26 whereas the outdoor fan 24 is driven by a fan motor 28. The drive speeds of the fans are preferably commanded by a control processor 30 that controls the fan motors through relay drivers. The fan motor 28 is preferably controlled by relay drive R1 whereas the fan motor 26 is controlled by relay drive R4. The reversing valve 16 is also controlled by the control processor 30 operating through the relay circuit R3. The compressor 14 is similarly controlled by the control processor 30 acting through relay circuit R2 connected to a compressor motor 32.

Referring to the control processor 30, it is to be noted that the control processor receives outdoor coil temperature values from a thermistor 34 associated with the outdoor coil 12. The control processor 30 also receives an indoor coil temperature value from a thermistor 36.

It is to be appreciated that the control processor 30 is operative to initiate a defrost action when certain temperature conditions indicated by the thermistors 34 and 36 occur. In order for the control processor 30 to detect the particular temperature conditions giving rise to a need to defrost, it is preferable that the processor perform a particular computation involving the indoor coil temperature as provided by thermistor 36. The particular computation performed by the control processor is based on having preferably conducted a series of tests of a particularly design of heat pump system of FIG. 1 as will now be described.

Figure 2:
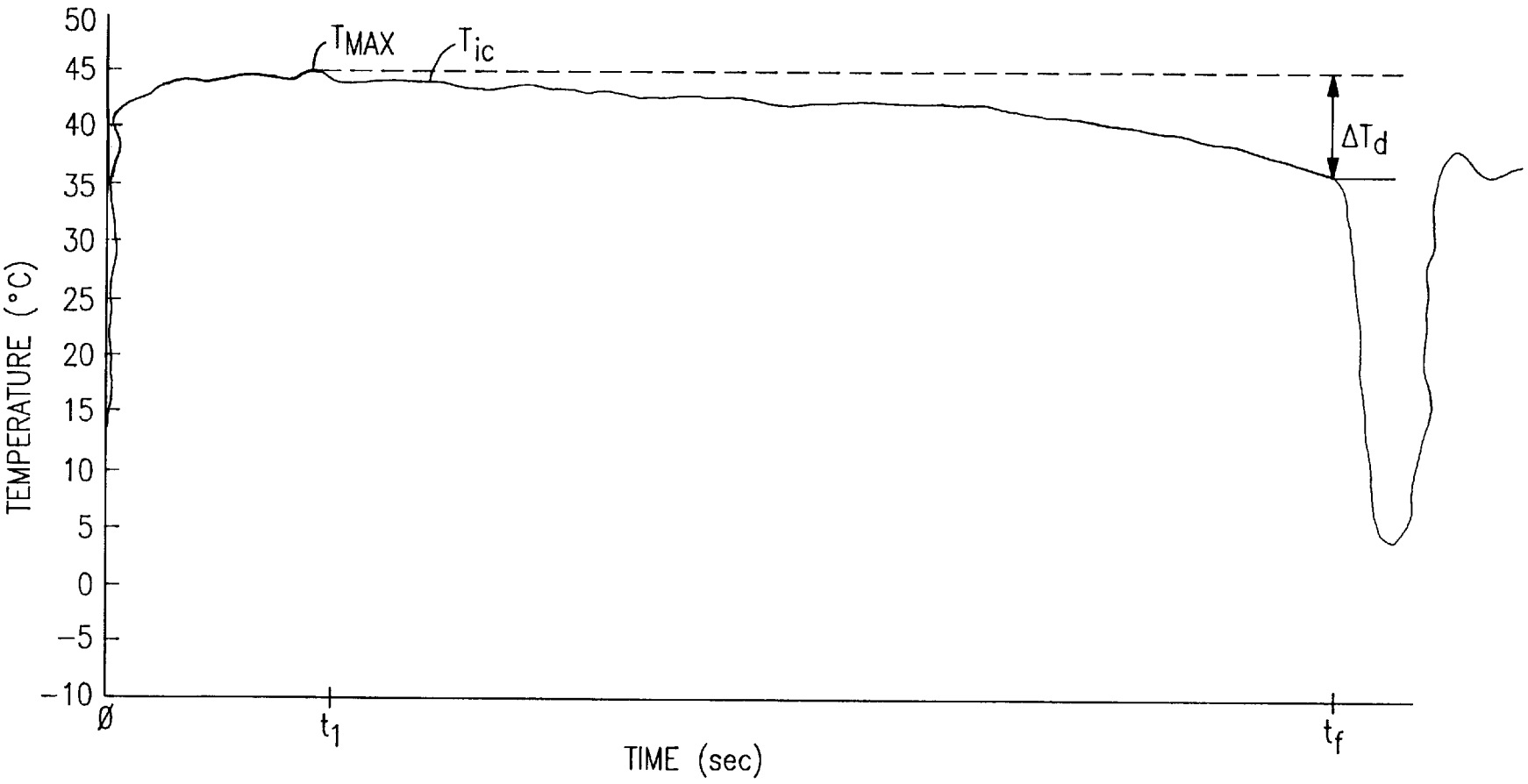
FIG. 2 is an illustration of the pattern of the temperature of the indoor condenser coil of the heat pump system when the heat pump is performing a particular heating operation.

Referring to FIG. 2, a graph depicting the temperature of the indoor coil temperature of the heat pump system of FIG. 1 for a given heating cycle is illustrated. The heating cycle occurs under a given set of ambient conditions and a given set of system conditions for the heat pump system. The ambient conditions include particular outdoor and beginning indoor air temperatures. The system conditions include particular fan speed settings and a particular amount of refrigerant in the system. The indoor coil temperature as measured by thermistor 36 is noted at periodic time intervals. At some point, the temperature of the indoor coil, $T_{ic}$ will have reached a maximum temperature as indicated by $T_{MAX}$ occurring at time $t_1$. The heating cycle will continue beyond $t_1$ with the temperature of the indoor coil $T_{ic}$ dropping off as frost begins to build up on the outdoor coil due to a cool outdoor temperature and the amount of moisture at this cool outdoor temperature. At some point in time, $t_f$, a significant amount of frost will have built up on the outdoor coil thereby causing a significant drop-off in the indoor coil temperature. This drop off in the indoor coil temperature is due to the decrease in heat transfer capacity of the circulating refrigerant as a result of a loss in the evaporator efficiency of the frosted outside coil. The difference between the maximum temperature of the indoor coil occurring at $t_1$ and the temperature of the indoor coil occurring at $t_f$ is noted as a defrost temperature difference, $\Delta T_d$.

The defrost temperature difference $\Delta T_d$ at time $t_f$ and the value of $T_{MAX}$ at time $t_1$ are both noted for the particular heating run. It is to be understood that additional heating runs will be conducted for other sets of particular ambient conditions and other sets of particular system conditions. The defrost temperature difference $\Delta T_d$ and the maximum indoor coil temperature difference $T_{MAX}$ will be noted for each such run. All noted values of $\Delta T_d$ and $T_{MAX}$ will be thereafter used as datapoints in a graph such as FIG. 3 to define a relationship between $\Delta T_d$ and $T_{MAX}$.

Figure 3:
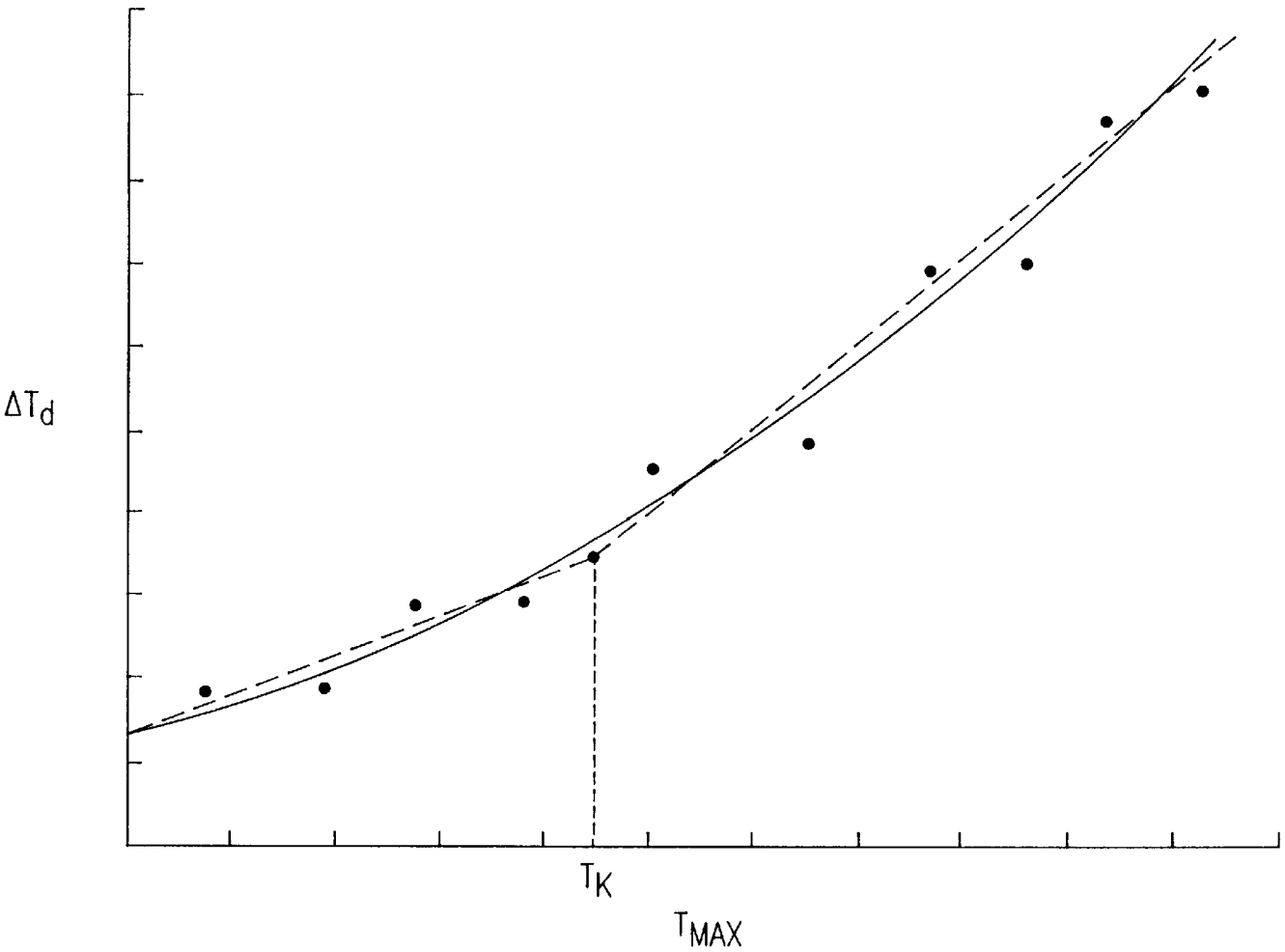
FIG. 3 illustrates how an allowable difference between the maximum indoor condenser coil temperature and measured indoor condenser coil temperature will vary as a function of the maximum indoor coil temperature.

Referring to FIG. 3, the curve drawn through the various data points produced by the heating tests of the particularly designed heat pump system is seen to be non-linear. This curve is preferably broken down into two linear segments with the first linear segment having a slope $S_1$, ending at a $T_{MAX}$ of $T_K$ and the second linear segment having a slope of $S_2$ beginning at the same point. The two linear segments may be expressed as follows:

$$\text{for } T_{MAX} \leqq T_K,\ \Delta T_d = S_1 * T_{MAX} - C_1$$

$$\text{for } T_{MAX} > T_K,\ \Delta T_d = S_2 * T_{MAX} - C_2$$

$C_1$ and $C_2$ are the $\Delta T_d$ coordinate values when $T_{MAX}$ equals zero for the respective linear segments. It is to be appreciated that the particular values of $T_K$, $S_1$, $S_2$, $C_1$ and $C_2$ will depend on the particular design of the heat pump system that has been tested. In this regard, each design of a heat pump system will have particularly sized components such as fans, fan motors, coil configurations and compressors that would generate their own respective FIGS. 2 and 3 and hence their own $T_K$, $S_1$, $S_2$, $C_1$ and $C_2$ values. As will be explained in detail hereinafter, the linear relationships derived for a particularly designed heat pump system will be used by the control processor 30 in a determination as to when to initiate a defrost of the outdoor coil 12 of such a system.

Figure 4A:
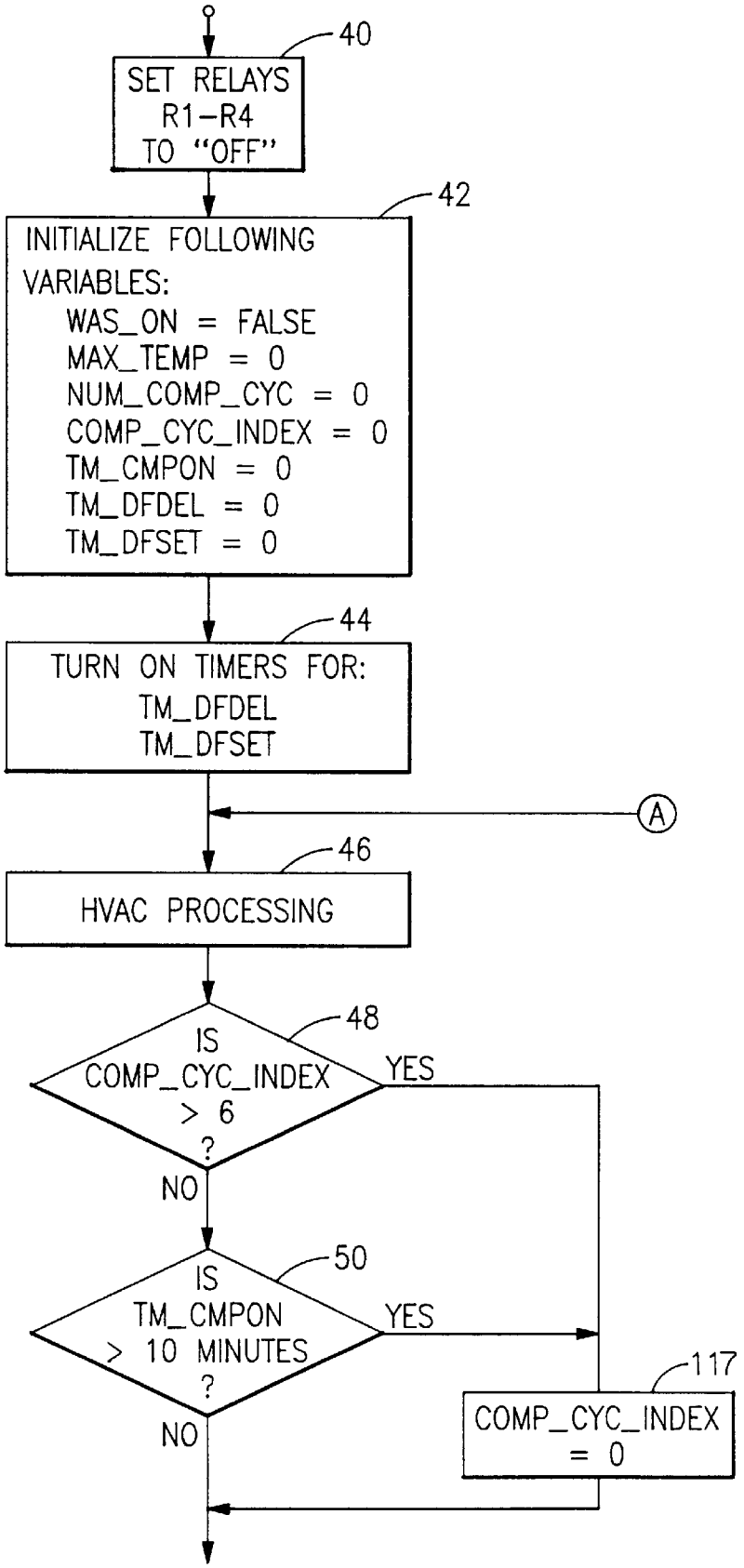
FIGS. 4A through 4E illustrate the sequence of steps to be performed by the computer control of the heat pump system in carrying out the initiation of a defrost action of the outside evaporator coil.
Figure 4B:
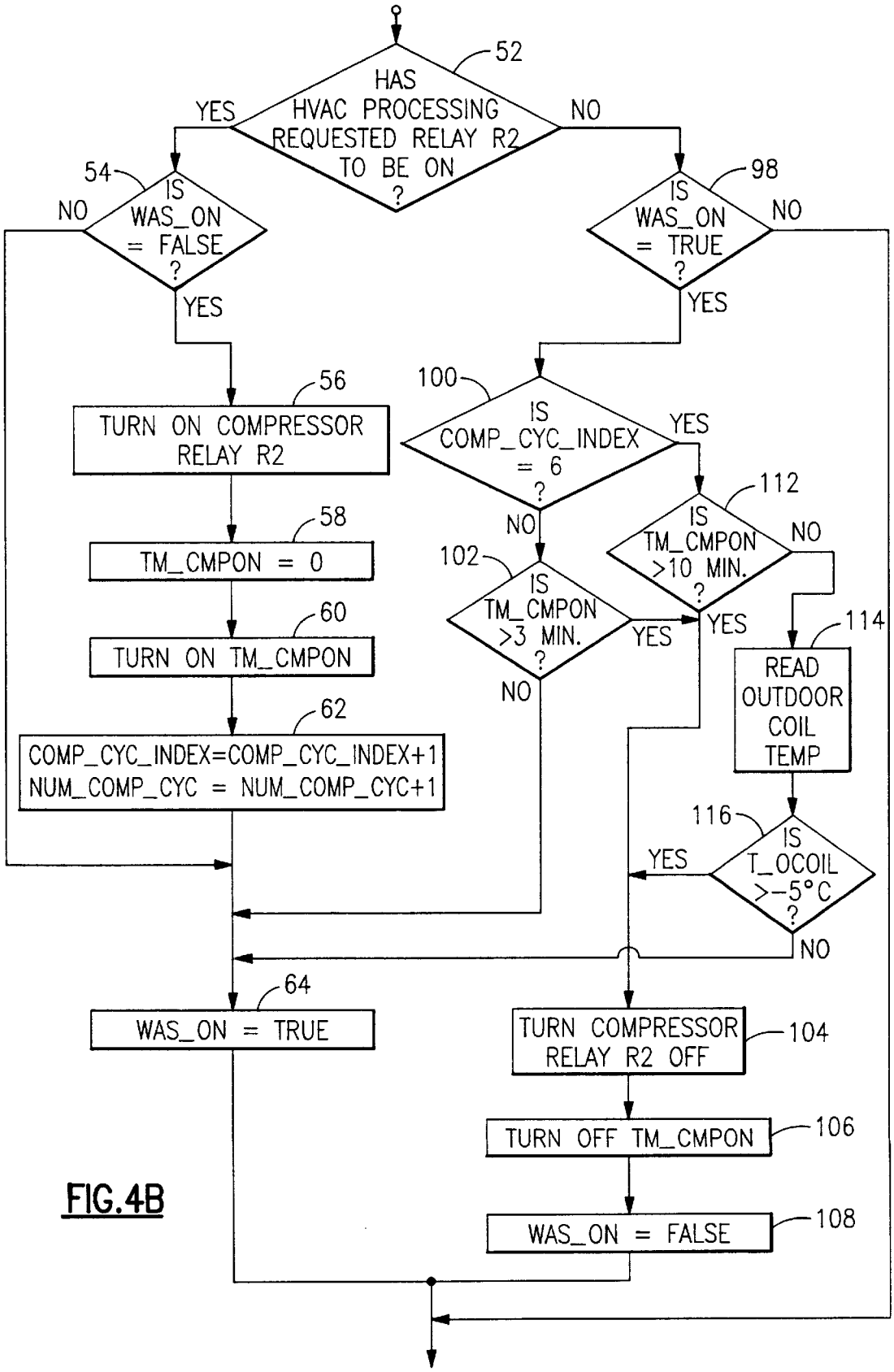
Figure 4C:
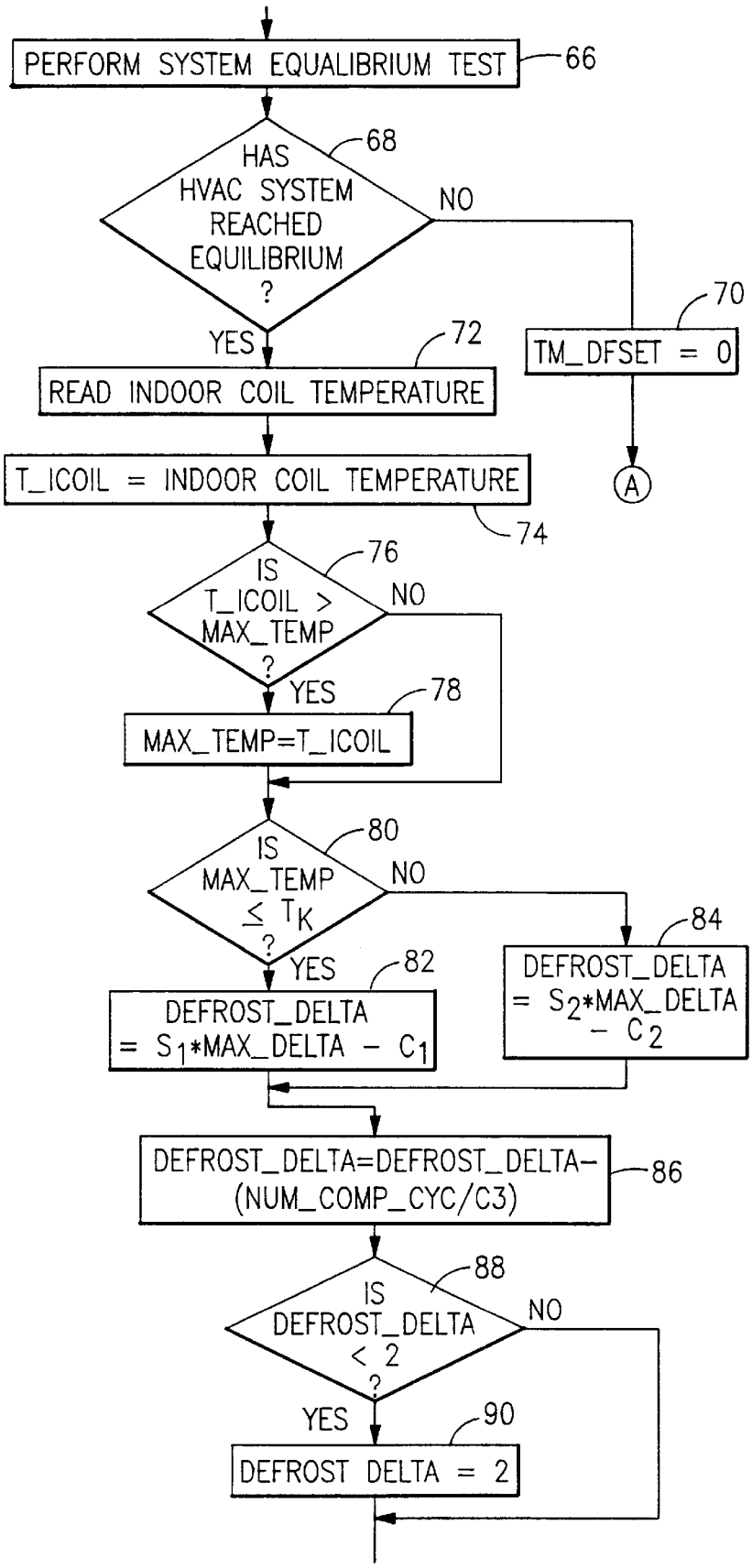
Figure 4D:
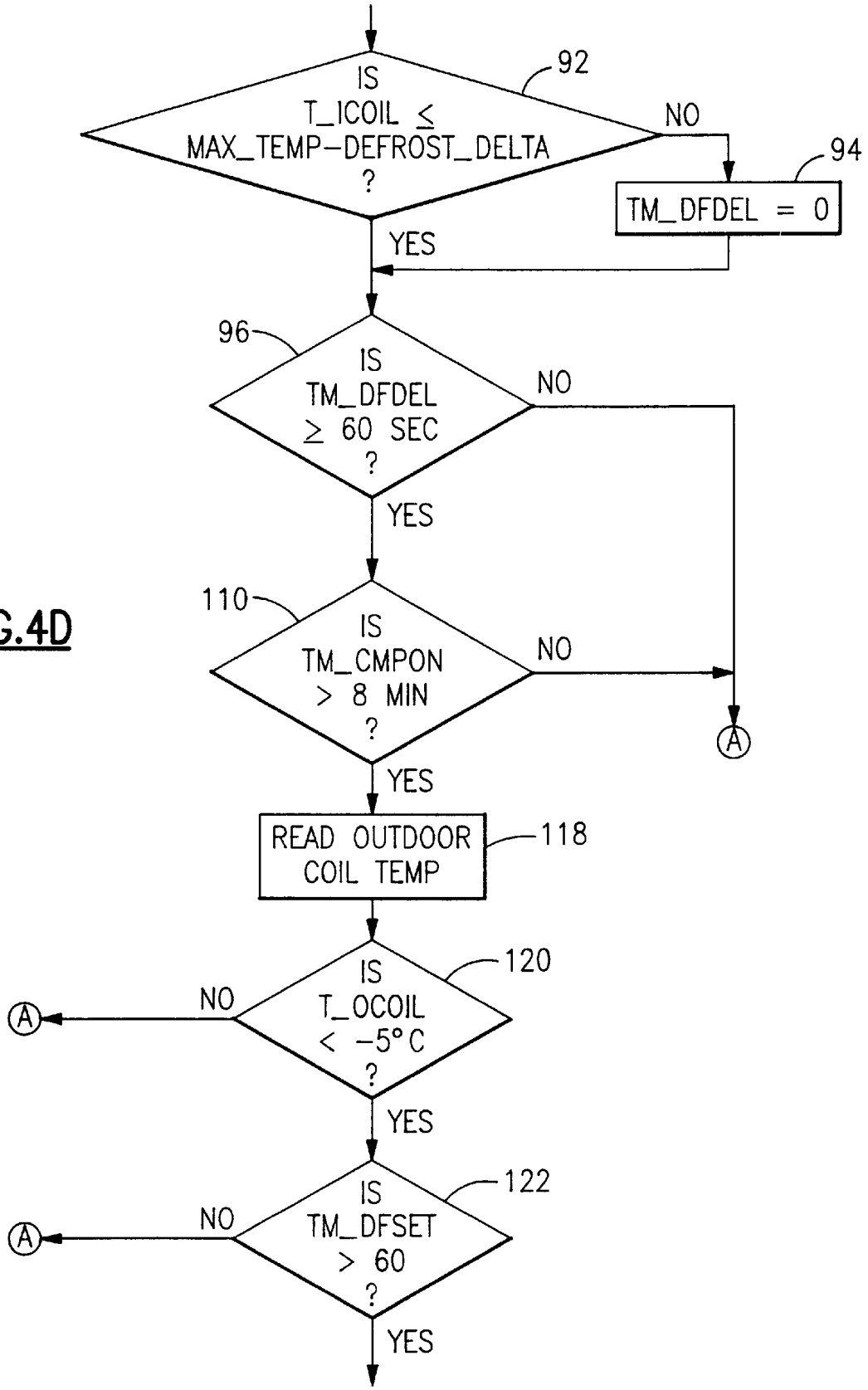
Figure 4E:
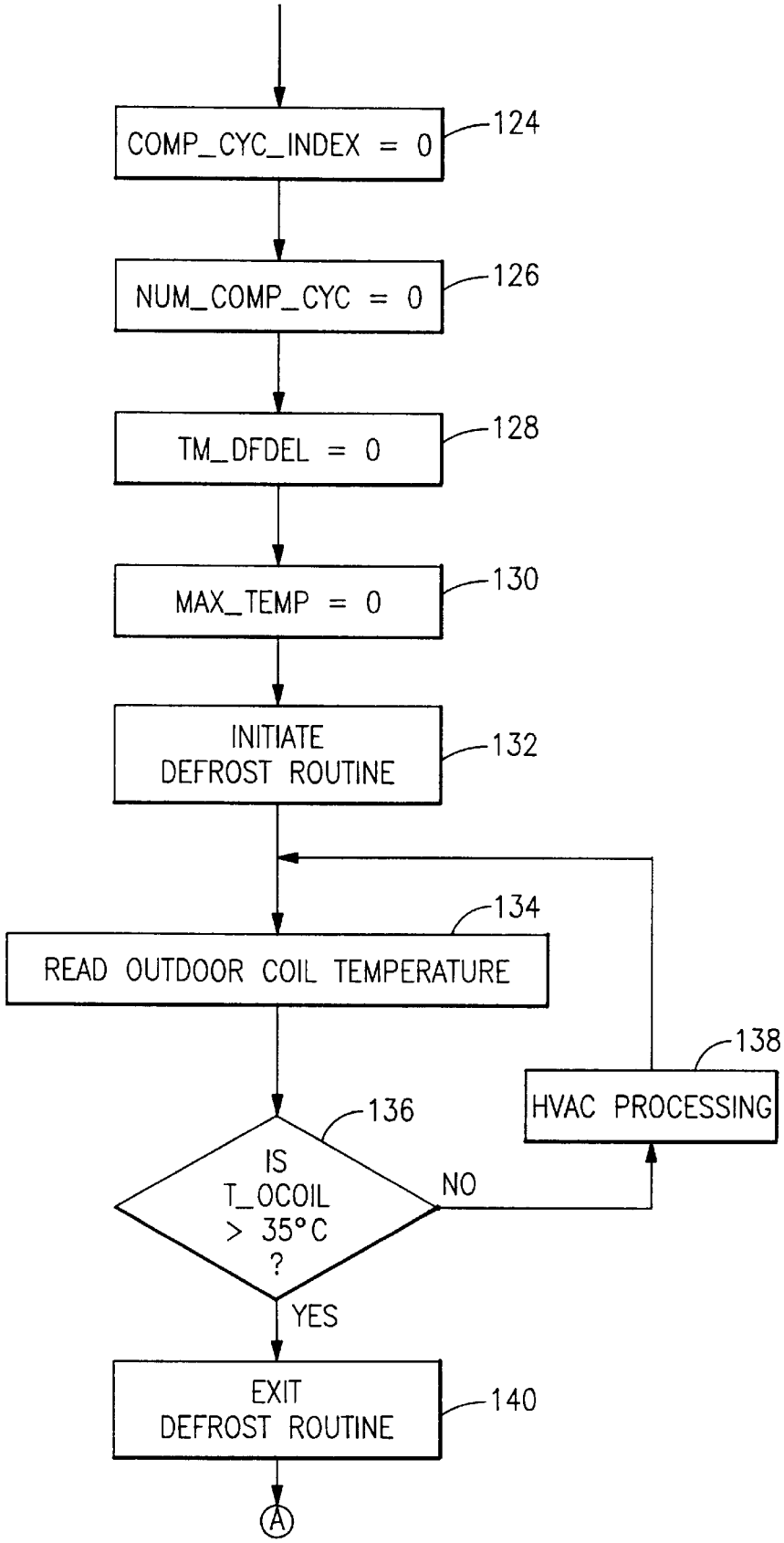

Referring to FIG. 4A, a series of initializations are undertaken by the control processor 30 before implementing any defrost control of the heat pump system. These initializations include setting the relays R1 through R4 to an off status so as to thereby place the various heat pump components associated therewith in appropriate initial conditions. This is accomplished in a step 40. The processor now proceeds to a step 42 and initializes an number of software variables that will be utilized within the defrost logic. A number of timers are next turned on in a step 44 so as to continuously provide values of time to the variables TM_DFDEL and TM_DFSET. The processor proceeds to conduct its normal HVAC processing control of the heat pump system in a step 46. It is to be appreciated that this will include the normal control of the various components of the heat pump system so as to respond to various demands for heat as may be required by a sensing of temperature within the building or space to be heated by the heat pump system of FIG. 1. This will include requests to turn the compressor motor 32 and hence the compressor 14 on or off to meet the demand for heat. The processor now proceeds to a step 48 and inquires as to whether the variable COMP_CYC_INDEX is greater than six. Since this variable is initially set equal to zero in step 42, the processor will ultimately proceed along the no path to a step 50 and inquire as to whether the variable TM_CMPON is greater than ten minutes. The processor will proceed along the no path from step 50 to a step 52 since this variable is initially set equal to zero in step 42. Referring to step 52, the processor inquires as to whether the HVAC processing of step 46 has requested that relay R2 be turned on. It will be remembered that the relay R2 is the relay for the compressor motor 32, which will turn on the compressor 14. Assuming that the HVAC processing of step 42 has resulted in a demand for heat, then the HVAC processing will have requested that the compressor relay R2 be turned on. This will prompt the processor to proceed along the yes path from step 52 to a step 54 and inquire whether the variable WAS_ON is false. Since this variable is initially set equal to false in step 42, the processor will proceed to turn on the compressor relay R2 in a step 56. The processor will set the variable TM_CMPON equal to zero in step 58 before proceeding to turn a clock associated with the variable TM_CMPON in a step 60. The processor next proceeds in step 62 to increment the variable COMP_CYC_INDEX as well as the variable NUM_COMP_CYC. It is to be appreciated that these particular variables are tracking the number of times the compressor 14 has been turned on. In particular, COMP_CYC_INDEX is tracking the number times the compressor 14 is turned on before certain steps are taken to assure that a defrost action is at least considered. As will be explained in detail hereinafter, the variable NUM_COMP_CYC tracks the total number of compressor cycles occurring between successive defrost operations of the heat pump system. The processor now proceeds to a step 64 and sets the variable WAS_ON equal to true. This variable is essentially a flag indicating that the compressor 14 is now on as a result of step 56. The processor now proceeds to a step 66 performs a system equilibrium test. It is to be appreciated that this particular test will involve an examination of the components of the heat pump system of FIG. 1 to determine whether or not the heat pump system has reached a steady state heat exchange condition. This would, for instance, include checking whether the compressor 14 remains on as well as whether the fans 22 and 24 have been operating at a given speed for a sufficient period of time so as to allow the normal heat exchange process to occur relative to indoor condenser coil 10 and the outdoor evaporator coil 12.

It is to be appreciated that until system equilibrium occurs, the processor will proceed along the no path from a step 68 and set the variable TM_DFSET equal to zero in a step 70. The processor will return to step 46 at this time and again execute the normal HVAC control processing of step 46 and proceed through steps 48, 50, 52 and 54 as long as the HVAC processing requires the compressor relay to be on. The processor will, however, now exit step 54 along the no path and proceed to a step 64 and hence to steps 66 and 68. At some point in time, the HVAC system will have reached equilibrium as a result of successively implementing these steps. At such time, the processor will proceed to a step 72 and read the indoor coil temperature provided by thermistor 36.

This value will be stored as T_ICOIL in step 74. The control processor will proceed to step 76 wherein an inquiry is made as to whether the value of T_ICOIL is greater than the value of a variable MAX_TEMP. It is to be appreciated that the value of MAX_TEMP will be zero when the control processor first initiates heating as a result of step 46. This will prompt the control processor to set MAX_TEMP equal to the current value of T_ICOIL in step 78. It is to be appreciated that the control processor will most likely continue to adjust the MAX_TEMP equal to the current value of T_ICOIL as the control processor repeatedly executes step 76 logic and encounters a rising value of T_ICOIL due to the indoor coil temperature rising. The control processor proceeds directly to step 80 following any adjustment to MAX_TEMP in step 78. The control processor will also proceed to a step 80 from step 76 in the event that the value of T_ICOIL is less than the presently stored value of MAX_TEMP.

Referring to step 80, the control processor proceeds to inquire whether MAX_TEMP is less than or equal to $T_K$. It will be remembered that the value of $T_K$ was arrived at in FIG. 3. In the event that MAX_TEMP is less than or equal to $T_K$, the control processor will proceed to a step 82 and calculate a value of DEFROST_DELTA. It is to be understood that the mathematical relationship between DEFROST_DELTA and MAX_TEMP in step 82 is the same as the linear relationship of $\Delta T_d$ to $T_{MAX}$ for $T_{MAX}$ less than or equal to $T_K$ in FIG. 3. Referring again to step 82, in the event that the value of MAX_TEMP is not less than or equal to $T_K$, the control processor will proceed along the no path to a step 84 and calculate the appropriate value of DEFROST_DELTA. It is to be appreciated that this calculation is the same as the relationship of $\Delta T_d$ versus $T_{MAX}$ in FIG. 3 for $T_{MAX}$ greater than $T_K$. The processor proceeds from having calculated an appropriate value of DEFROST_DELTA in either step 82 or 84 to a step 86 wherein the computed value of DEFROST_DELTA is further adjusted by the value of the variable NUM_COMP_CYC divided by the constant C3. As has been previously noted, the variable NUM_COMP_CYC will track the number of on cycles of the compressor 14 since the last defrost. This variable will also track the number of cycles of the compressor 14 since the system was initially turned on as is the case presently being discussed. This numerical value will preferably be further adjusted by a constant C3 reflecting the particular fractional adjustment to the value of the variable NUM_COMP_CYC. The constant C3 is preferably determined from testing the heat pump system in a laboratory. The number of compressor cycles that are necessary to start a frosting of the coil is noted along with the temperature of the indoor coil. Knowing this number, the equation for DEFROST_DELTA can be used to solve.

The processor proceeds from step 86 to a step 88 wherein inquiry is made as to whether the calculated value is less than two. In the event that the calculated value is less than two, the control processor adjusts the same to be equal to two in step 90. The control processor will thereafter proceed to step 92. It is to be noted that the processor will also have proceeded to step 94 via the no path from step 88 in the event the DEFROST_DELTA is equal to or greater than two.

Referring to step 92, inquiry is made as to whether the current value of T_ICOIL is less than the difference between MAX_TEMP and DEFROST_DELTA. It is to be appreciated that the inquiry being made in step 92 is essentially a check as to whether the currently measured indoor coil temperature has decreased to a value that is more than the value of DEFROST_DELTA below the maximum indoor coil temperature as defined by the value of MAX_TEMP. It is to be appreciated that the value of the currently measured indoor coil temperature will normally not have decreased to such a value since the outdoor coil will normally not experience a significant frost build up. In such situations, the control processor will continue to pursue the no path out of step 92 and set the variable TM_DFDEL equal to zero in a step 94. The processor will thereafter proceed from step 94 to a step 96 and inquire as to whether the variable TM_DFDEL is greater than or equal to sixty seconds. This variable will be zero as long as the indoor coil temperature is greater than the difference between MAX_TEMP and DEFROST_DELTA. The processor will accordingly proceed along the no path out of step 96 and return to step 46. The processor will continue to execute steps 46 through 96 as previously discussed until either the HVAC processing step 46 requests that the compressor relay be turned off or the temperature of the indoor coil drops below the difference between MAX_TEMP and DEFROST_DELTA.

In the event that the HVAC processing requests that the compressor relay R2 be turned off, then the processor will proceed to exit step 52 along the no path to step 98. Since the variable WAS_ON is still true, the processor will proceed to step 100 and inquire as to whether COMP_CYC_INDEX is equal to six. As long as the value of COMP_CYC_INDEX is less than six, the processor will proceed to step 102 and inquire whether the variable TM_CMPON is greater than three minutes. If the compressor 14 has not been on for the requisite three minutes, the processor will proceed to reset the variable WAS_ON equal to true in step 64 before again implementing steps 66 through 96 and returning to step 52. It is to be appreciated that at some point in time, the compressor will have been on for the requisite three minutes when the processor again encounters step 102. If the HVAC processing step continues to request that the compressor relay be switched off, then the processor will proceed along the yes path out of step 102 and turn the compressor relay R2 off in a step 104. The processor will proceed to a step 106 and disable the further storing of the time count in TM_CMPON so as to thereby hold the value of this variable at a particular count of time.

The processor proceeds to set the variable WAS_ON equal to false in step 108 before proceeding through steps 66, 68 and 70. Since the heat pump system now normally not in equilibrium the processor will proceed through step 70 and again return to step 46.

It is to be appreciated that at some point in time, the HVAC processing step 46 will again require further activation of the compressor 14 so as to perform another heating operation. At this point in time, the processor will proceed from step 52 along the yes path and turn the compressor relay R2 on in step 56 before resetting the value of TM_CMPON equal to zero in step 58. The clock associated with this variable will start recording time assigned to this variable in step 60. The COMP_CYC_INDEX will be incremented by one as well as the variable NUM_COMP_CYC in step 62. The WAS_ON flag will be set equal to true in step 64. The processor will proceed through steps 66, 68 and 70 and return to step 46 until such time as the heat pump system reaches equilibrium. The processor will proceed to also execute steps 72 through 92 once the heat pump system reaches equilibrium.

As has been previously noted, the temperature of the indoor coil will be compared with the difference between MAX_TEMP and DEFROST_DELTA in step 92. In the event that T_ICOIL drops below this difference, the control processor will proceed directly to step 96 and inquire whether TM_DFDEL is greater than sixty seconds. TM_DFDEL will exceed sixty seconds when indoor coil temperature remains below the difference of MAX_TEMP and DEFROST_DELTA for more than sixty seconds. This temperature condition of the indoor coil requires that the processor now check whether the value of the variable TM_CMPON is greater than eight minutes in step 110. It will be remembered that TM_CMPON measures the amount of time the compressor has been on since the compressor relay R2 was turned on in step 56. The value of TM_CMPON may not exceed eight minutes if the heat pump system is able to raise the temperature in the room to be heated in less than eight minutes. In this case, the processor will note that the HVAC processing step 46 has ceased to request that the compressor relay R2 be on. This will prompt the processor to proceed from step 52 to step 98 and 100. If the COMP_CYC_INDEX is less than six, then the processor will check to see whether the compressor 14 has run for at least three minutes in step 102 before turning the compressor off in step 104.

At some point, the compressor 14 will have been turned on for a sixth operating cycle. This may in fact occur without the compressor 14 having been on for more than eight minutes in any one operating cycle. When this occurs, the variable COMP_CYC_INDEX will be incremented to six in step 62. The processor will execute steps 46 through 92 as have been previously discussed. In the event that the temperature of the indoor coil is below the difference between MAX_TEMP and DEFROST_DELTA, then the processor will so note in step 92. The processor will proceed to step 110 if the indoor coil temperature remains below this difference for sixty seconds. The processor will inquire as to whether the compressor 14 has been on for more than eight minutes in step 110. In the event that subsequent execution of step 46 results in a request that the compressor be turned off before eight minutes have elapsed, then the processor will proceed along the no path out of step 52 to step 98 and hence out of step 98 to step 100. Since the COMP_CYC_INDEX is now six, the processor will proceed along the yes path from step 100 to step 112 wherein inquiry is made as to whether the variable TM_CMPON is greater than ten. Since the compressor will not have been on for even eight minutes, the processor will proceed from step 112 to step 114 and read the outdoor coil temperature from the thermistor 34. The thus read value will be stored in the variable T_OCOIL. The value of the variable T_OCOIL is next queried for being greater than minus five degrees centigrade in step 116. In the event that the temperature of the outdoor coil 12 is greater than minus five degrees centigrade, then the processor will merely turn the compressor relay R2 off in step 104, as has been previously discussed. It is to be appreciated that the control processor will ultimately return to step 46 in the event that the compressor relay R2 is turned off As some point in time, the HVAC processing step 46 will again require that a heat pump operation be initiated which will prompt the COMP_CYC_INDEX variable to be incremented by one in step 62, which will be noted upon the next execution of step 48 thereby prompting the processor to proceed to step 117 and set the variable COMP_CYC_INDEX equal to zero.

Referring again to step 116, in the event that the temperature of the outdoor coil is not greater than minus five degrees centigrade, then the control processor will proceed along the no path from step 116 to step 64 and set the variable WAS_ON equal to true. The processor will next proceed to execute steps 64 through 110. The processor will continue to execute steps 46 through 52, 98 through 116, and then steps 64 through 110 as long as the temperature of the outdoor coil remains below minus five degrees centigrade and the temperature of the indoor coil remains below the difference of MAX_TEMP and DEFROST_DELTA.

When the total amount of accumulated compressor on time exceeds eight minutes, the control processor will proceed from step 110 to a step 118 to read the outdoor coil temperature from the thermistor 34 and store this value in the variable T_OCOIL. The control processor will next inquire in a step 120 to inquire as to whether the outdoor coil temperature value that is stored in the variable T_OCOIL is less than minus five degrees centigrade. If the outdoor coil temperature is not less than minus five degrees centigrade, the control processor will simply proceed to step 46, as has been previously discussed. Referring again to step 120, in the event that the temperature of the outdoor coil is less than minus five degrees centigrade, the control processor will proceed to step 122 and inquire as to whether the variable TM_DFSET is greater than sixty seconds. It is to be remembered that this variable reflects the time count of how long the heat pump system has been in equilibrium as a result of the control processor having only allowed this clock count variable to begin counting upwardly to any appreciable extent following the heat pump system reaching equilibrium. If this has for some reason not occurred, the processor will return to step 46 and continue to execute steps 46 through 52, 98 through 116, and 64 through 122 until sixty seconds have elapsed following system equilibrium having been reached. The processor next proceeds to set the variable COMP_CYC_INDEX equal to zero in step 124. The processor will also set the variable NUM_COMP_CYC equal to zero in a step 126 and will furthermore set the variable TM_DFDEL equal to zero in a step 128 and the variable MAX_TEMP equal to zero in a step 130. The processor will now proceed to a defrost routine in a step 132. It is to be appreciated that the defrost routine will include setting the relay R3 so that the reversing valve 16 will reverse the direction of the refrigerant flow between the fan coils 10 and 12. The defrost routine will also set relay R1 so as to cause the outdoor fan 24 to be turned off. The subsequent reversal of refrigerant flow with the fan 24 being off will cause the outdoor coil to absorb heat from the refrigerant thereby beginning the removal of any frost build up on the coil 12. The control processor will proceed from step 132 to a step 134 and read the outdoor coil temperature. The processor will next inquire in a step 136 as to whether the temperature of the outdoor coil as measured by the thermistor 34 has risen to a temperature greater than thirty-five degrees centigrade. It is to be appreciated that the outdoor coil will take some time to rise to this temperature. During this time, the processor will exit along the no path from step 136 and implement an HVAC processing control step 138. This step will be the same as the HVAC control processing step 46 except that any change in the relay settings required by the defrost routine will not be allowed to occur.

The control processor will exit from the HVAC processing control of step 138 and again read the outdoor coil temperature in step 134. Inquiry will next be made as to whether the thus read outdoor coil temperature exceeds thirty-five degrees centigrade. It is to be appreciated that at some point in time, due to the continual defrosting of the outdoor coil, that a temperature of more than thirty-five degrees centigrade will be achieved. This will prompt the processor to proceed to defrost routine. This will include resetting the reversing valve R3 and the outdoor fan relay R1 to on. The processor will proceed from step 140 back to step 46.

It is to be noted that the control processor is now out of the defrost routine as a result of returning to step 46. As has been previously described, the control processor will execute the HVAC processing control of step 46 and proceed to inquire whether the COMP_CYC_INDEX is greater than six in step 48. Since the COMP_CYC_INDEX will have been initialized to zero before initiating defrost, the control processor will proceed along the no path to inquire whether the variable TM_CMPON is greater than ten minutes. Since TM_CMPON will now be greater than ten minutes, the processor will proceed along the yes path and redundantly set the COMP_CYC_INDEX to zero in step 117. The processor next proceeds to step 52 and inquires whether or not the HVAC processing has requested that a relay R2 be turned on. In the event that the HVAC processing of step 46 has required that the compressor be turned on, then the processor will proceed along the yes path and implement steps 54 through 64 in the manner as has been previously discussed. In this regard, if the variable WAS_ON will still be true as a result of the compressor not being turned off following the completion of the defrost routine. The processor will hence proceed along the no path to step 64 and hence through steps 66 through 120. Since the outdoor coil temperature will be greater than minus five degrees centigrade, the processor will return to step 46. In the event that the HVAC step does not require that the relay be turned on, then the processor will so note in step 52 and proceed to step 98. Since the variable WAS_ON is still true, the processor will proceed along the yes path to step 100 and then along the no path to step 102. Since the compressor will now have been running for considerably more than three minutes, the processor will proceed along the yes path to step 104 and turn the compressor relay R2 off. The variable WAS_ON will be set equal to false in step 108. The processor will next proceed to execute steps 66, 68 and 70. The processor will eventually proceed back to step 46 and continue to execute the previous steps that were executed until such time as the step 46 again requests that the compressor relay be turned on.

It is to be noted that the above description of the processor has focused on implementing a defrost routine during the sixth cycle. In the event that a defrost routine was not initiated, then the COMP_CYC_INDEX will not have been set equal to zero. This will prompt the processor to increment this variable by one when a request to turn the compressor relay on is again noted in step 52. The processor will ultimately return to step 46 and so note that the COMP_CYC_INDEX is now seven. This will prompt a resetting of this variable to zero in step 117.

It is to be noted that any successive resetting of the COMP_CYC_INDEX to zero without implementing a defrost will not however impact the number of cycles being recorded in the variable NUM_COMP_CYC. In this regard, this variable will continue to track the number of computer cycles since the last defrost. This value will be used of course in the computation of the DEFROST_DELTA value in step 86. To this extent, the value of the variable NUM_COMP_CYC will continue to influence the DEFROST_DELTA computation and will accordingly adjust it to a lower value depending on the number of cycles of the compressor since the last defrost. This will tend to trigger an earlier defrost since the temperature of the indoor coil will not have had to decrease to the amount of the defrost delta below the MAX_TEMP value. The earlier triggering of defrost will hence be reflected in the tracking of the compressor on cycles since previous defrost.

It is to be appreciated that a defrost routine will again only be initiated if the compressor time TM_CMPON exceeds eight minutes as required by the step 110. This will, of course, occur in the event that the compressor is in a sixth cycle as indicated by the index COMP_CYC_INDEX equaling six and the temperature of the outdoor coil being greater than minus five degrees centigrade. Once these conditions have been satisfied, the defrost routine will again be implemented until such time as the temperature of the outer coil reaches thirty-five degrees centigrade.

While the invention has been described with reference to a preferred embodiment, it will be understood by those skilled in the art that various changes may be made thereto without departing from the scope of the invention. For instance, the values of the particular times allotted to the timing variables, such as TM_CMPON, may be changed in accordance with the particular heat pump system. The various values of temperature used to trigger certain events may also be changed for a particular heat pump system. It is therefore intended that the invention not be limited to the particular embodiment disclosed, but that the invention include all embodiments falling within the scope of the claims hereinafter set forth.

What is claimed is:

1. A method of initiating a defrost of an evaporator coil of a heat exchange system, said method comprising the steps of:

switching a compressor in the heat exchange system on in response to a demand for a conditioning of air by the heat exchange system;

counting the number of times the compressor has been switched on in response to a demand for a conditioning of air by the heat exchange system;

switching the compressor in the heat exchange system off when the demand for conditioning of air by the heat exchange system has been met by the heat exchange system unless the count of the number of times the compressor has been switched on has reached a predetermined number of counts; and determining whether a defrost action of the evaporator coil should be initiated while the compressor remains on after the demand for conditioning of air has been met when the number of times the compressor has been switched on reaches the predetermined number of counts.

2. The method claim 1 wherein said step of determining whether a defrost of the evaporator coil should be initiated comprises the steps of:

sensing the temperature of the evaporator coil when the predetermined count is reached;

inquiring as to whether the sensed temperature of the evaporator coil is above a predetermined value of temperature; and turning the compressor off if the sensed temperature of the evaporator is above the predetermined value.

3. The method of claim 1 wherein said step of determining whether a defrost action of the evaporator coil should be initiated comprises the steps of:

counting the number of times the compressor has been switched on since the last defrost of the evaporator coil; and computing a temperature threshold at which defrost may be initiated as a function of the count of the number of times the compressor has been switched on since the last defrost of the evaporator coil.

4. The method of claim 3 wherein said step of computing the temperature threshold at which defrost will be initiated comprises:

repetitively reading the temperature of a condenser coil of the heat exchange system following the last defrosting of the evaporator coil;

determining the maximum condenser coil temperature to have been read following the last defrosting of the outdoor coil; and computing a limit as to the drop in the condenser coil temperature that may be permitted from the determined maximum condenser coil temperature wherein the limit is computed as a function of the then determined maximum condenser coil temperature and the number of times the compressor has been switched on since the last defrost of the evaporator coil.

5. The method of claim 3 wherein said step of determining whether a defrost action of the evaporator coil should be initiated further comprises:

sensing the temperature of the condenser coil;

comparing the sensed temperature of the condenser coil with the computed temperature threshold at which defrost may be initiated; and proceeding to further determine whether a defrost action of the evaporator coil should be initiated when the sensed temperature of the condenser coil drops below the temperature at which defrost may be initiated.

6. The method of claim 3 wherein said step of computing a temperature threshold at which defrost may be initiated as a function of the count of the number of times the compressor has been switched on since the last defrost of the evaporator coil comprises:

adjusting the number of times the compressor has been switched on since the last defrost of the evaporator coil by a predetermined constant; and computing a temperature threshold at which defrost may be initiated as a function of the adjusted number of times the compressor has been switched on since the last defrost of the evaporator coil.

7. The method of claim 4 wherein said step of computing a limit as to the drop in the condenser coil temperature that may be permitted comprises:

adjusting the number of times the compressor has been switched on since the last defrost of the evaporator coil by a predetermined constant; and computing the limit as to the drop in the condenser coil that may be permitted from the determined maximum condenser coil temperature wherein the limit is computed as a function of the then determined maximum coil temperature and the adjusted number of times the compressor has been switched on since the last defrost of the evaporator coil.

8. The method of claim 1 wherein said step of determining whether a defrost action of the evaporator coil should be initiated comprises the steps of:

monitoring the time of operation of the compressor in the heat exchange system from when the compressor is switched on; and proceeding to further determine whether a defrost action of the evaporator coil should be initiated when the monitored time of operation of the compressor in the heat exchange system exceeds a predetermined period of time of operation of the compressor.

9. The method of claim 8 wherein the predetermined period of time of operation of the compressor exceeds the period of time before the compressor is normally switched off in response to the demand for conditioning air by the heat exchange system being met.

10. The method claim 1 wherein the heat exchange system is a heat pump and wherein the demand for a conditioning of air by the heat exchange system is a demand for heat resulting in response to a determination that the air to be conditioned is to be heated by the heat pump.

11. The method of claim 1 further comprising the steps of:

determining whether a defrost action may be required each time the compressor is switched on;

monitoring the amount of time the compressor remains on each time the compressor is switched on;

proceeding to a defrost action only if the monitored amount of time the compressor remains on exceeds a predetermined period of on time of the compressor when the count of the number of times the compressor has been switched on does not equal the predetermined number of counts whereby a defrost action will not be initiated pursuant to said step of determining whether a defrost action may be required unless the predetermined period of on time of the compressor has been exceeded.

12. A system for initiating a defrost of an evaporator coil of a heat exchange system, said system comprising:

a switch associated with a compressor in the heat exchange system;

at least one device for defrosting the evaporator coil in the heat exchange system;

computing means being operative to turn the switch associated with the compressor on in response to a demand for a conditioning of air by the heat exchange system, said computer means being operative to count the number of times the switch associated with the compressor has been turned on, said computer means being furthermore operative to turn the switch associated with the compressor off when the demand for conditioning of air has been met by the heat exchange system unless the count of the number of times the switch associated with the compressor has been switched on has reached a predetermined number of counts, said computer means being still furthermore operative to determine whether a signal is to be sent to said device for defrosting the evaporator coil in the heat exchange system while the switch associated with the compressor remains on when the number of times the compressor has been switched on reaches the predetermined count.

13. The system of claim 12 further comprising:

a sensor for sensing the temperature of the evaporator coil; and wherein said computer means is operative to read the sensed temperature of the evaporator coil when the predetermined count is reached and thereafter turning the switch associated with the compressor off if the sensed temperature of the evaporator coil is above a predetermined value of temperature for the evaporator coil.

14. The system of claim 12 wherein said computer means is furthermore operative to count the number of times the switch associated with the compressor has been switched on since the last defrost of the evaporator coil, said computer means being furthermore operative to compute a temperature threshold at which defrost may be initiated as a function of the number of times the switch associated with the compressor has been turned on since the last defrost of the evaporator coil.

15. The system of claim 14 further comprising:

a sensor for sensing the temperature of a condenser coil in the heat exchange system; and wherein said computer means is furthermore operative to compare the sensed temperature of the condenser coil with the computed temperature threshold at which defrost may be initiated, said computer being furthermore operative to determine whether a defrost action should be initiated when the sensed temperature of the condenser coil is below the computed temperature threshold.

16. The system of claim 12 wherein said computer means is furthermore operative to monitor the amount of time the switch associated with the compressor remains on each time the switch is turned on, said computer means being operative to proceed to determine whether a defrost action is to be initiated if the monitored amount of time the compressor remains on exceeds a predetermined period of time.

17. The system of claim 12 wherein said heat exchange system is a heat pump.

18. The system of claim 17 wherein said device for defrosting the evaporator coil in the heat exchange system is a reversing valve within the heat pump for reversing the flow of refrigerant within the heat pump.

* * * * *